US010029882B2

(12) United States Patent
Newhouse et al.

(10) Patent No.: US 10,029,882 B2
(45) Date of Patent: Jul. 24, 2018

(54) LOOPED PILE FILM ROLL CORE

(71) Applicant: 3M INNOVATIVE PROPERTIES COMPANY, St. Paul, MN (US)

(72) Inventors: Kevin B. Newhouse, Houlton, WI (US); Bruce E. Tait, Woodbury, MN (US); Terence A. Lee, Decatur, AL (US); Michael L. Smith, Decatur, AL (US); Kyle Taggart, Athens, AL (US); Stanley T. Mann, Cullman, AL (US); Ronald L. Holmes, Eva, AL (US); Timothy J. Edman, Stillwater, MN (US); Mark T. Reed, Simpsonville, SC (US); Carsten Franke, St. Paul, MN (US); Chris J. Tanley, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 14/432,643

(22) PCT Filed: Sep. 30, 2013

(86) PCT No.: PCT/US2013/062521

§ 371 (c)(1),
(2) Date: Mar. 31, 2015

(87) PCT Pub. No.: WO2014/055380

PCT Pub. Date: Apr. 10, 2014

(65) Prior Publication Data

US 2015/0274483 A1 Oct. 1, 2015

Related U.S. Application Data

(60) Provisional application No. 61/709,430, filed on Oct. 4, 2012.

(51) Int. Cl.
*B65H 75/10* (2006.01)
*B65H 19/28* (2006.01)
(Continued)

(52) U.S. Cl.
CPC ..... *B65H 75/10* (2013.01); *B65H 18/28* (2013.01); *B65H 19/28* (2013.01); *B65H 75/28* (2013.01);
(Continued)

(58) Field of Classification Search
CPC ..... B65H 75/10; B65H 18/28; B65H 19/28; B65H 75/28
See application file for complete search history.

(56) References Cited

U.S. PATENT DOCUMENTS 2,651,241 A * 9/1953 Hornbostel ..... D21G 1/0206 100/162 B
3,010,194 A * 11/1961 Fratzke ..... B29C 63/20 156/285
(Continued)

FOREIGN PATENT DOCUMENTS

CH 515838 11/1971
DE 1952385 4/1971
(Continued)

OTHER PUBLICATIONS

International Search Report for PCT International Application No. PCT/US2013/062521, dated Dec. 13, 2013, 5pgs.

*Primary Examiner* — Michael E Gallion

(57) ABSTRACT

The disclosure generally relates to a looped pile film roll core used for winding a polymeric film, a method of winding film on the looped pile film roll core, and a roll of film that includes the looped pile film roll core. The disclosure describes an article and a process to reduce the core impressions created by the starting end of a web on the adjacent
(Continued)

web layers next to the core. In one particular embodiment, the present disclosure can lead to a reduction in the amount and severity of such core impressions on a wound polymeric film, by reducing the amount of stress in adjacent layers of wound web.

19 Claims, 4 Drawing Sheets

(51) Int. Cl.
*B65H 75/28* (2006.01)
*B65H 18/28* (2006.01)

(52) U.S. Cl.
CPC ..... *B65H 2301/41427* (2013.01); *B65H 2301/41428* (2013.01); *B65H 2511/166* (2013.01)

(56) References Cited

U.S. PATENT DOCUMENTS 3,070,281 A * 12/1962 Durkin ..... B65D 59/04 138/144
3,571,878 A * 3/1971 Alderfer ..... B65H 75/08 242/118.3
3,737,030 A 6/1973 Stewart
4,697,757 A * 10/1987 Nakaya ..... B65H 75/26 242/610.4
4,739,945 A * 4/1988 Yokoe ..... B65H 75/08 242/118.41
4,783,019 A 11/1988 Schmidt
4,832,276 A * 5/1989 Gebhardt ..... B65H 75/10 242/573.7
4,934,622 A * 6/1990 Hakiel ..... B65H 75/10 242/160.4
5,240,198 A * 8/1993 Dorfel ..... B65H 18/20 242/542.4
5,286,614 A * 2/1994 Ishizaki ..... B65H 75/10 242/610.6
5,478,619 A * 12/1995 Fujikura ..... B29C 61/06 29/447
5,514,429 A * 5/1996 Kamihgaraguchi ... B65H 75/10 138/132
5,762,289 A 6/1998 Suzuki
5,803,398 A * 9/1998 May ..... B65H 18/26 242/541
5,816,525 A * 10/1998 De Roeck ..... B65H 18/00 242/160.1
5,857,643 A * 1/1999 Czuprynski ..... B65H 75/10 242/609.1
6,042,048 A 3/2000 Czuprynski
6,719,242 B2 * 4/2004 Floyd, Jr. ..... B29C 63/18 242/609.4
9,751,710 B2 * 9/2017 Newhouse ..... B65H 27/00
9,845,216 B2 * 12/2017 Newhouse ..... B65H 27/00
2003/0148866 A1 8/2003 Westerkamp

FOREIGN PATENT DOCUMENTS

DE 3811326 1/1989
DE 20-2009-017716 5/2010
EP 0233541 8/1987
EP 613849 9/1994
FR 515838 1/1972
JP 64-015516 A 1/1989
WO WO 1996-40578 12/1996
WO WO 2011-038248 3/2011
WO WO 2011-038279 3/2011
WO WO 2012-083019 6/2012
WO WO 2014-035850 3/2014

* cited by examiner

LOOPED PILE FILM ROLL CORE

BACKGROUND

During the process of manufacturing polymeric films such as optical films, the web needs to be wound onto cores to form the rolls of material to be sold. Typically, a cut transfer process is used to begin winding the web onto the core. In a cut transfer process, the starting end of the web is adhered to a core using a strip of adhesive tape, or a strip of doubled sided adhesive tape. Because of this attachment scheme, the leading edge of the web is over-lapped by the subsequent layers of wound web, and causes an effective disparity on the core surface which can increase the stress in adjacent web layers. This disparity can propagate impressions to several adjacent layers of the web, causing defects that are often referred to as core impressions. These core impressions can be observed on many of the initial layers of wound web material on each roll, and can be considered as wasted product.

SUMMARY

The disclosure generally relates to a looped pile film roll core used for winding a polymeric film, a method of winding film on the looped pile film roll core, and a roll of film that includes the looped pile film roll core. The disclosure describes an article and a process to reduce the core impressions created by the starting end of a web on the adjacent web layers next to the core. In one particular embodiment, the present disclosure can lead to a reduction in the amount and severity of such core impressions on a wound polymeric film, by reducing the amount of stress in adjacent layers of wound web. In one aspect, the present disclosure provides a film roll core that includes a cylindrical tube having an outer surface and an engagement cover comprising a resilient looped pile fabric, the engagement cover disposed over the outer surface of the cylindrical tube.

In another aspect, the present disclosure provides a method of winding film that includes disposing a film tangentially adjacent to a film roll core, the film roll core having a cylindrical tube including an outer surface and an engagement cover comprising a resilient looped pile fabric, the engagement cover disposed over the outer surface of the cylindrical tube; adhering the film to the engagement cover; maintaining tension on the film; and rotating the film roll core about a central axis, thereby winding the film onto the film roll core.

In yet another aspect, the present disclosure provides a roll of film that includes a film roll core having a cylindrical tube having an outer surface and an engagement cover comprising a resilient looped pile fabric, the engagement cover disposed over the outer surface of the cylindrical tube; and a web of film wound around the engagement cover, wherein a first film edge of the web of film compresses the engagement cover such that subsequently wound layers of the web of film include minimal impressions of the first film edge and/or a transfer tape secured to the first film edge.

The above summary is not intended to describe each disclosed embodiment or every implementation of the present disclosure. The figures and the detailed description below more particularly exemplify illustrative embodiments.

BRIEF DESCRIPTION OF THE DRAWINGS

Throughout the specification reference is made to the appended drawings, where like reference numerals designate like elements, and wherein.

The figures are not necessarily to scale. Like numbers used in the figures refer to like components. However, it will be understood that the use of a number to refer to a component in a given figure is not intended to limit the component in another figure labeled with the same number.

DETAILED DESCRIPTION

Figure 1A:
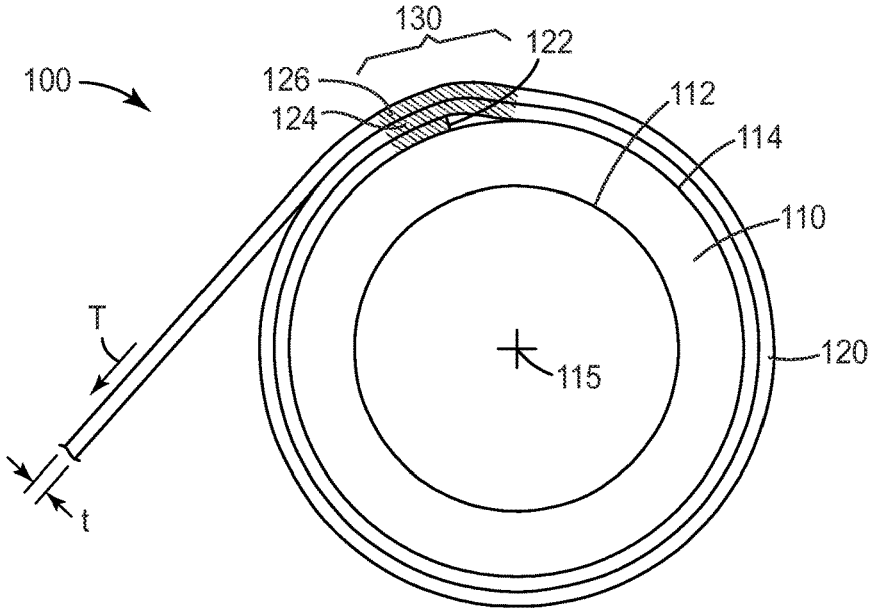
FIG. 1A Prior Art
FIGS. 1A-1B shows a cross-sectional schematic of a prior art film roll core.

The present disclosure describes an article and a process to reduce the core impressions created by the starting end of a web on the adjacent web layers next to the core. Typically, web (for example, film) is attached to the core during the winding process using a double sided transfer tape along with other types of tape, for example a silicone tape. However, some films such as polyester film have a very high modulus so that the irregularities of the transfer tapes and starting edge of the web are transferred through the adjacent layers of wound film. These irregularities are commonly known as core impressions which make the film defective and unusable. These core impressions can lead to the scrapping of up to 400 yards on material on every roll of film wound.

In one particular embodiment, the present disclosure can lead to a reduction in the amount and severity of such core impressions on a wound polymeric film, by reducing the amount of stress in adjacent layers of wound web. The article can be described as a film roll core having a looped pile exterior that provides a resilient engagement surface, such that the starting end and the transfer tape imparts minimal stress on a subsequent wound film layer.

One impact of the present disclosure is the cost savings that can be gained by being able to use more of the film next to the core instead of scrapping it due to core impressions. Further, the current technique leaves transfer tape and adhesive residue on the steel cores that must be removed prior to re-use of the core. However, using the present disclosure, the transfer tape stays on the film and not the cores, so cleaning of the cores is not needed.

Film rollers having coverings that use looped pile exteriors providing a resilient engagement surface have been described for use with transport rollers in a webline, for example, in PCT Patent Publication Nos. WO 2011/038279, entitled WEB CONVEYANCE METHOD AND APPARATUS USING SAME; WO 2011/038248, entitled METHOD FOR MAKING ENGAGEMENT COVER FOR ROLLERS FOR WEB CONVEYANCE APPARATUS; and also in U.S. Patent Application Ser. No. 61/694,300 entitled ADAPTABLE WEB SPREADING DEVICE (filed Aug. 29, 2012). It has now been surprisingly discovered that similar coverings that use looped pile exteriors providing a resilient engagement surface can be used on the surface of film roll cores to provide the unexpected benefit of reduction of core impressions that plague web processing. In some cases, with proper selection of the resilient engagement surface, there can also be a reduction in the tendency for "spoking" (that is, radial deformities in wound film rolls) and other winding defects.

In one particular embodiment, the looped pile film roll core can be fabricated by covering a film core with a resilient material that can be used as a resilient engagement surface. In one particular embodiment, the resilient material can be a knit fabric comprising a base layer having first and second faces and a resilient looped pile protruding from the first face.

In some cases, a circular knitted polyester sleeve with terry loops can be positioned over a core which is steel, plastic, fiber or combination thereof to reduce the amount of core impressions seen at the center of a wound roll of film. As used herein, "terry" is a popular term for some forms of knit looped-pile fabric, although the term "terry" is not intended to limit the knit looped-pile fabric in any way. The circular knitted polyester sleeve with terry loops layer allows enough compliancy to reduce the radial stresses on the center material but is firm enough not to allow the wound material to collapse and create spoking and other winding defects. The circular knitted polyester sleeve with terry loops material also allows for the double sided transfer tape to stick to the film and not the core so the steel cores need no cleaning of tape adhesive residue and fiber cores are not damaged and can be reused.

This present disclosure is not limited to steel cores but can also be used on fiber cores, composite cores, and the like. The circular knitted polyester sleeve with terry loops material can be put on fiber cores to help reduce the core impressions but also keep the transfer tape from damaging the fiber cores. Because the material covers the core face, the transfer tape cannot damage the core so they can be reused. Currently the transfer tape can stick to the fiber cores and can peel fiber material off the core if the transfer tape is removed, thereby damaging the cores.

The cores described herein can have advantages over foam wrapped cores, such as those described in PCT Published Application WO2012/083019, entitled OPEN GAP FILM ROLL CORE, that are currently being used. The foam wrapped cores and double sided taped cores can only be used one time since the foam or tape will damage a fiber core if it were to be removed. A circular knitted polyester sleeve with terry loops wrapped core can be used several times before the knitted surface shows signs of wear, in part because there are reduced stress concentration factors and more control of radial strain with the cores described herein.

The following terms are used herein as having the indicated meaning; other terms are defined elsewhere in the specification.

"Convey" is used to mean moving a web from a first position to a second position wherein the web passes through engaging contact with a roller.

"Engaging contact" is used to refer to contact between the web and the roller such that as the web is conveyed it engages with the engagement cover of the roller compressing the cover in response to contact with the web.

"Engagement surface" is the radially outwardly facing portion of the engagement cover that is directly contacted with the web when the web is conveyed.

"Engagement zone" is the portion of the engagement surface that is in direct contact with the web at a particular moment.

"Resilient" is used to refer to the capability of being deformed or compressed and then recovering to earlier shape or loft.

"Web" refers to a flexible, elongate ribbon or sheet of material.

In the following description, reference is made to the accompanying drawings that forms a part hereof and in which are shown by way of illustration. It is to be understood that other embodiments are contemplated and may be made without departing from the scope or spirit of the present disclosure. The following detailed description, therefore, is not to be taken in a limiting sense.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein.

As used in this specification and the appended claims, the singular forms "a," "an," and "the" encompass embodiments having plural referents, unless the content clearly dictates otherwise. As used in this specification and the appended claims, the term "or" is generally employed in its sense including "and/or" unless the content clearly dictates otherwise.

Spatially related terms, including but not limited to, "lower," "upper," "beneath," "below," "above," and "on top," if used herein, are utilized for ease of description to describe spatial relationships of an element(s) to another. Such spatially related terms encompass different orientations of the device in use or operation in addition to the particular orientations depicted in the figures and described herein. For example, if an object depicted in the figures is turned over or flipped over, portions previously described as below or beneath other elements would then be above those other elements.

As used herein, when an element, component or layer for example is described as forming a "coincident interface" with, or being "on" "connected to," "coupled with" or "in contact with" another element, component or layer, it can be directly on, directly connected to, directly coupled with, in direct contact with, or intervening elements, components or layers may be on, connected, coupled or in contact with the particular element, component or layer, for example. When an element, component or layer for example is referred to as being "directly on," "directly connected to," "directly coupled with," or "directly in contact with" another element, there are no intervening elements, components or layers for example.

The web material will typically be provided in roll form, for example, wound upon itself or on a core, but may be provided in other configuration if desired. The present disclosure may be used with a wide variety of web materials, illustrative examples including plastics, paper, metal, and composite films or foils.

In some embodiments, the web material is provided from an intermediate storage state, for example, from an inventory of raw materials and/or intermediate materials. In other embodiments, the web material may be provided to the process of the present disclosure directly from precursor processing, for example, such as the take off feed from a film forming process.

The web material may be single layer or multilayer, in some instances the described invention is used to convey the web material through manufacturing operations in one or more additional layers and/or one or more treatments are applied to a web material.

Configuring the web material into passing configuration simply refers to arranging the web material into position and orientation such that it can be put into engaging contact with the engagement surface of a roller in accordance with the disclosure. In many embodiments, this will simply comprise unrolling a portion of the web material which is in roll form such that it can be put into engaging contact with the engagement surface. In other illustrative embodiments, the web material is formed in a precursor portion of the operation, that is, in line, and passed directly into a web conveying apparatus without having been wound into roll form, for example, the polymeric material is extruded or cast in line to form a film which, at that point is in passing configuration without ever having been wound into roll form, is the web material conveyed by the apparatus of the disclosure.

FIG. 1A shows a cross-sectional schematic of a prior art film roll core 100. In FIG. 1A, prior art film roll core 100 includes a cylindrical tube 110 having an inside surface 112, an outside surface 114 and a center of rotation 115. Inside surface 112 is typically mounted on the mandrel of a film winding apparatus (not shown). A starting end 122 of a polymeric film 120 is disposed on the outside surface 114 of the cylindrical tube 110, and the polymeric film 120 is wound around the cylindrical tube 110. The starting end 122 of the polymeric film 120 may be attached to the core using an adhesive layer coated on the outside surface 114 of the core, or by a double-sided adhesive tape (not shown). A region of increased stress 130 is generated by the tension "T" applied to the polymeric film 120 as a first wrap overlap 124 of polymeric film 120 overlays the starting end 122. The region of increased stress 130 can result in a visible deformation in the polymeric film. The first wrap overlap 124 generally follows the contour of the surface over which it is wrapped, and the starting end 122 generates a step-change in the outside surface 114 of the cylindrical tube, corresponding to the thickness "t" of the polymeric film. A subsequent second wrap overlap 126 overlays the first wrap overlap 124 and the starting end 122, again resulting in a visible deformation in the polymeric film 120 in the region of increased stress 130.

Figure 1B:
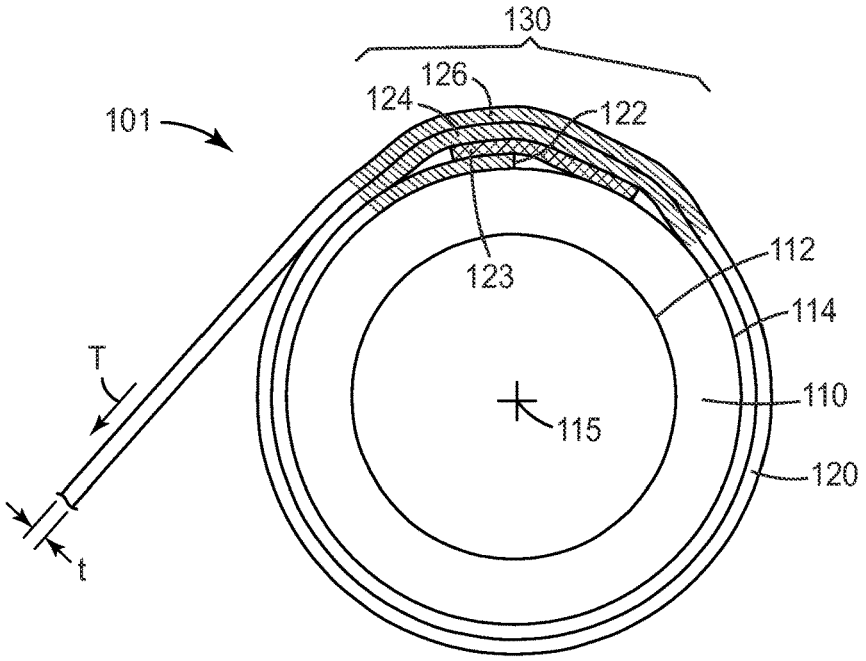
FIG. 1B Prior Art

FIG. 1B shows a cross-sectional schematic of a prior art film roll core 101. In FIG. 1B, prior art film roll core 101 includes a cylindrical tube 110 having an inside surface 112, an outside surface 114 and a center of rotation 115. Inside surface 112 is typically mounted on the mandrel of a film winding apparatus (not shown). A starting end 122 of a polymeric film 120 is disposed on the outside surface 114 of the cylindrical tube 110, and the polymeric film 120 is wound around the cylindrical tube 110. The starting end 122 of the polymeric film 120 can be attached to the core using an adhesive tape 123 on the outside surface 114 of the core. A region of increased stress 130 is generated by the tension "T" applied to the polymeric film 120 as a first wrap overlap 124 of polymeric film 120 overlays the starting end 122 and the adhesive tape 123. The region of increased stress 130 can result in a visible deformation in the polymeric film. The first wrap overlap 124 generally follows the contour of the surface over which it is wrapped, and the starting end 122 generates a step-change in the outside surface 114 of the cylindrical tube, corresponding to the thickness "t" of the polymeric film, as well as a second step-change in the outer surface corresponding to the thickness of the adhesive tape 123. A subsequent second wrap overlap 126 overlays the first wrap overlap 124, the starting end 122, and the adhesive tape 123, again resulting in a visible deformation in the polymeric film 120 in the region of increased stress 130.

The film core roll according to the present disclosure includes an engagement cover that is on the exterior of the film core roll. The engagement cover can be fabricated from a material which is compliant and conformable, such as a knit looped pile fabric, as described elsewhere. A web can be transferred to the core by a cut transfer process that precisely cuts the web, and adheres the starting end of the web to the engagement cover using either a single-sided adhesive tape or a double-sided adhesive tape. Because the fabric material of the engagement cover can adhere less vigorously to the adhesive tape, minimal damage may occur after removal of the material, and the film core roll can be reused repeatedly after removal of the tape and film. The engagement cover can be fabricated to be very compliant, such that the compressive effect of many subsequent layers of film being wound onto the roll causes the starting end of the web to compress the portion of the engagement cover on which it lies. This causes the starting end of the web to fall to (or below) the surface of the engagement cover, so the next layer of wound web covers the starting web end, resulting in minimized stresses. These minimized stresses can reduce core impressions on the adjacent web layers, and as a result improve the yield of web processing lines by reducing waste.

An advantage of the present invention is that typically engagement covers may be readily installed on existing film core rolls without significant equipment change or significant reconfiguration. Thus, existing web conveying apparatuses may be readily refit with film roll cores having the engagement covers of the invention to achieve attendant improvements in performance.

The manner in which the engagement cover is mounted on a cylindrical tube is dependent upon such factors as the configuration and type of the cores, and the material to be wound. During operation, the engagement cover should not slide or stretch on the underlying tube as this can lead to damage to the web, or other impairment of performance. In many instances, when the engagement cover is simply a knit fabric as described herein and has a snug fit to the surface of the underlying tube, the second face of the engagement cover will remain firmly positioned on the core during operation. In some instances, mounting means such as an intermediate adhesive, mated hook and loop fasteners, rigid shell which attaches to the core, etc. can be used.

In preferred embodiments, the engagement cover is knit fabric as described in, for example, co-pending PCT Publication Nos. WO2011/038279 and WO2011/038284, and which can be mounted on the core as a removable sleeve. The sleeve is preferably seamless and should be of appropriate size to fit around core snugly without developing any loose bulges or ridges. In many embodiments, the sleeve will be configured to extend beyond both ends of the core sufficiently far that it can be cinched and tied; if the core is of appropriate dimension this action typically tends to pull the sleeve tight. Typically the core should be at least as wide as the web, preferably wider than the web to ease concerns about alignment of the traveling web.

Mounting the engagement cover on the core may be achieved by conventional means dependent in part upon the nature of the engagement cover and that of the conveying apparatus. Preferably the engagement cover does not slide on the core during operation. In many embodiments, the cover is in the form of a sleeve that fits snugly on the core, optionally extending beyond the ends of the core sufficiently to be cinched there. In some embodiments, the engagement cover and surface of the core exhibit sufficient frictional effect, in some instances additional means such as adhesive or hook and loop type fastener mechanisms may be used.

While it is typically desirable for the base of a sleeve of the engagement cover to stretch so as to achieve a snug fit on the core, the base should not stretch during operation so as to cause bunching underneath the web being wound. Alternatively, cores may be manufactured with engagement covers as described herein being more strongly attached to the outer surface thereof. Further, an advantage of removable embodiments is that it will typically be easier and cheaper to replace removable engagement covers on a core to replace the engagement surface of rather than refinishing a core having an integrated engagement surface in accordance with the disclosure.

In a typical embodiment, the cover is made with a knit fabric having a pile-forming loop at every stitch. In an illustrative embodiment there are 25 stitches per inch (1 stitch per millimeter). The fibrous material(s) used to make the fabric may be single filament strands, multifilament strands (for example, two or more strands wound together to yield a single thread), or combinations thereof.

In many embodiments, the looped pile has a loop height (that is, dimension from the plane defined by the top of the base layer to the apex of the pile loops) of from about 0.4 to about 3.0 mm or more, or from about 1.0 to about 3.0 mm, preferably from about 1.25 to about 2.7 mm. It will be understood that engagement covers having looped pile having loop heights outside this range may be used in certain embodiments. If the loop height is insufficient, the cover may fail to provide effective cushioning effect to the web to achieve the full benefits of the disclosure. If the loop height is too high, the pile may tend to get floppy and undesirably affect web during winding, or damage the wound web.

The pile should be sufficiently dense to be supportive of the web during winding so as to reliably achieve the benefits of the disclosure. For instance, the looped pile comprises fibers selected to have an appropriate denier for the application, with thicker fibers providing relatively greater resistance to compression. Illustrative examples include fibers having a denier from about 50 to about 500, or from about 50 to about 300, or preferably from about 70 to 200. As will be understood, fibers having a denier outside this range may be used in some embodiments in accordance with the disclosure.

In illustrative embodiments, the fibrous material(s) can be selected from the group consisting of poly(tetrafluoroethylene) (PTFE such as, for example, TEFLON® fiber), aramid (for example, KEVLAR®), polyester, polypropylene, nylon, wool, bamboo, cotton, or combinations thereof. However, those skilled in the art will be able to readily select other fibers which can be effectively knit and used in covers of the disclosure. In some cases, the fibrous material can comprises a material that shrinks when exposed to heat, moisture, or a combination thereof, such as wool, cotton, polyvinylalcohol (PVA), polyester, or a combination thereof.

The base is typically knit so as to provide the desired properties to permit it to be placed on a roller and used in accordance with the disclosure, for example, stretch and slide sufficiently easily over the roll to permit it to be installed while not stretching undesirably during operation.

Some illustrative examples of materials that can be used as sleeves to make engagement covers of the disclosure include: HS4-16 and HS6-23 polyester sleeves from Syfilco Ltd., Exeter, Ontario, Canada; WM-0401C, WM-0601, and WM-0801 polyester sleeves from Zodiac Fabrics Company, London, Ontario, Canada or its affiliate Carriff Corp., Midland, N.C.; and BBW3310TP-9.5 and BBW310TP-7.5 sleeves from Drum Filter Media, Inc., High Point, N.C.

Typically, knit fabrics are made using fibrous materials that have been treated with lubricants to facilitate the knitting process. When the resultant knit fabrics are used in web conveyance operations in accordance with the disclosure, such lubricants may tend to wear away causing variation in frictional performance to the web and potential contamination issues. Accordingly, it is typically preferred to wash or scour fabrics used as roller covering herein.

The material(s) selected should be compatible with the web materials and operating conditions, for example, stable and durable under the ambient operating conditions, for example, temperature, humidity, materials present, etc. It has been observed that, if the engagement cover material(s) are of contrasting color to the web materials, observation of debris capture by the engagement cover is facilitated, for example, using black polyester fibers in an engagement cover to be used with a transparent film web.

Typically, because of the requirements of the knitting processes used to make them, knit fabrics are made with fibrous materials that have limited elastomeric character so that the fibers can be moved around in contact with one another to form the desired knit. In many instances, lubricants are applied to the fibers to facilitate the knitting process. It is preferred to remove such lubricants from knits used in the present disclosure, for example, by cleaning or scouring the material such as by washing it before using it. In some instances, the knit can be put into service as an engagement surface of the disclosure with a lubricant being worn away.

Typically it is preferred that the loop pile of the engagement cover provide a coefficient of friction to the web of from about 0.25 to about 2, with about 1.0 or more often being preferred, though engagement covers providing coefficients of friction outside this range may be used if desired.

In some cases, in order to simultaneously achieve desired frictional properties with the web, abrasion resistance, radial modulus of elasticity, and resilience of the loop pile, quantities of selected polymeric relatively elastomeric (as compared to the fibrous pile material(s)) materials can be applied to the engagement surface to form grip enhancement elements that raise the effective coefficient of friction (COF) between the engagement surface and web, if desired.

The described invention may be used with known web cores, including for example, rubber cores, metal cores (for example, aluminum, steel, tungsten, etc.), polymeric cores, composite cores, and paper cores. Cores may be solid or hollow, although hollow cores (that is, tubes) are preferred.

Figure 2:
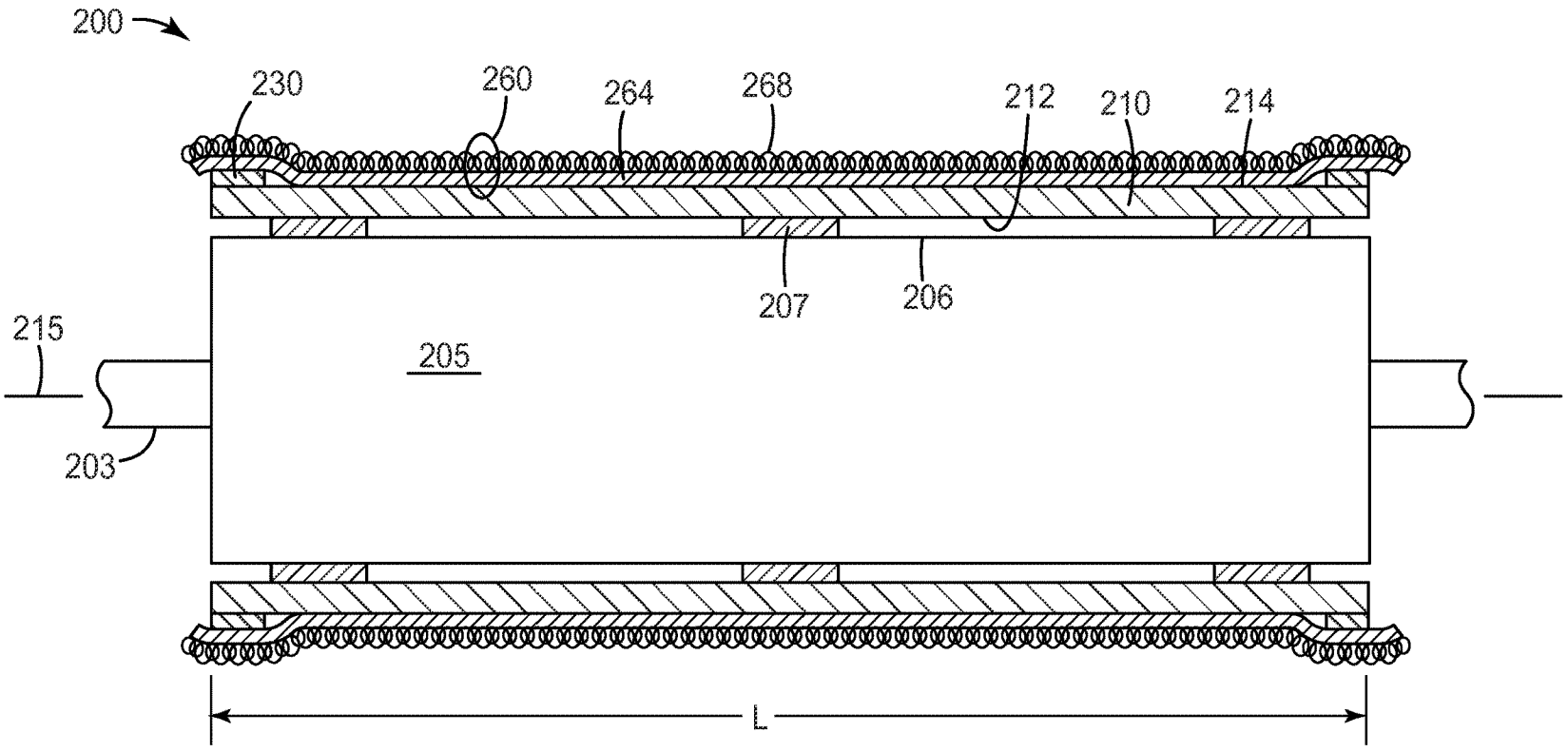
FIG. 2 shows a side cross-sectional view of a film roll core.

FIG. 2 shows a side cross-sectional view of a film roll core 200, according to one aspect of the disclosure. Film roll core 200 includes a cylindrical tube 210 having an inner surface 212, an outer surface 214 and a length "L". The cylindrical tube 210 can be releasably attached to a mandrel 205 having an axle 203 which rotates within bearings (not shown) around an axis of rotation 215. In one particular embodiment, the cylindrical tube 210 can be releasably attached to the mandrel 205 using, for example, a plurality of expandable members 207 that extend beyond an outer mandrel surface 206 when the cylindrical tube 210 is attached, and retract into the outer mandrel surface 206 to release the cylindrical tube 210. An engagement cover 260 comprising a resilient looped pile fabric 268 and a base layer 264 is disposed over the outer surface 214 of the cylindrical tube 210, such that the base layer 264 is adjacent the outer surface 214. In some cases, additional layers (not shown) such as compliant layers including rubber, closed- or open-celled foam, and the like, can be disposed between the base layer 264 and the outer surface 214 of the cylindrical tube 210.

The engagement cover 260 can be attached to the outer surface 214 of the cylindrical tube 210 using any suitable technique including, for example, compression, adhesion, mechanical attachment, or a combination thereof. Generally, it can be preferable to releasably attach the engagement cover to the outer surface 214 of the cylindrical tube 210 so that different covers can be used on the same tube; however, in some cases the attachment can be more permanently made. In some cases, the engagement cover 260 can be attached using compression by including a fiber in the engagement cover 260 that shrinks upon exposure to heat and/or moisture such as, for example, wool fibers, cotton fibers, polyvinylalcohol (PVA) fibers, and the like. In one particular embodiment, PVA fibers can be spun into a yarn and then woven such as those under the trade designation Solvron® available from Nitivy Co. Ltd., Tokyo, Japan, can be especially preferred for a material that shrinks upon exposure to heat and moisture. In some cases, the engagement cover can be non-releasable attached to the outer surface 214 of the cylindrical tube 210 using adhesives including, for example, two-sided transfer tapes, solvent coated PSAs, hot-melt adhesives, and the like. In some cases, the engagement cover 260 can be affixed to the outer surface 214 using a plurality of optional mechanical attachment elements 230. In one particular embodiment, the mechanical attachment elements 230 can be a hook portion of a hook-and-loop mechanical fastener such as, for example, Scotchmate™ Hook & Loop Tape available from 3M Company, that is adhesively attached near the ends of the outer surface 214.

Figure 3A:
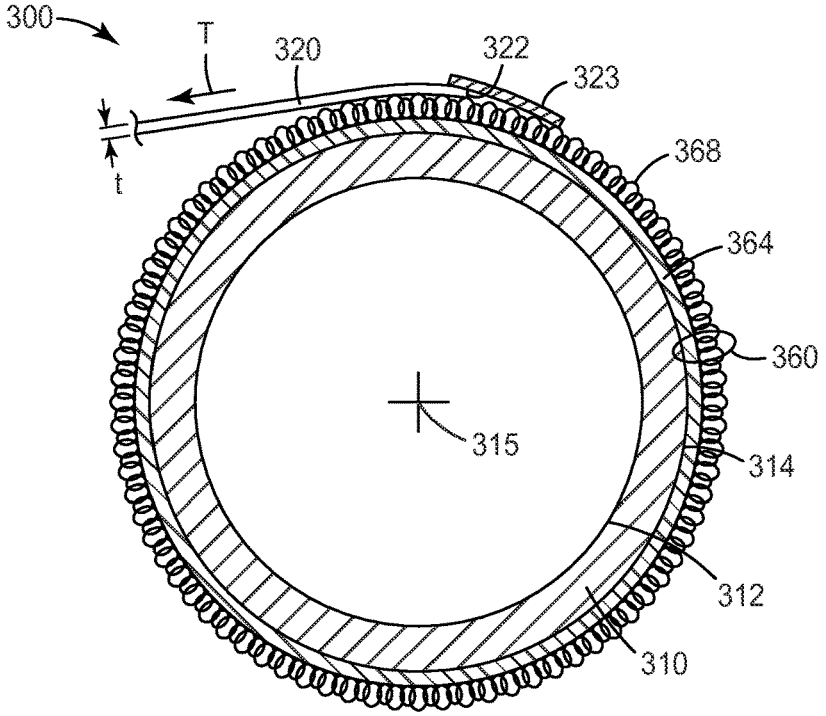
FIG. 3A shows a cross-sectional end view of a film roll core.

FIG. 3A shows a cross-sectional end view of a film roll core 300, according to one aspect of the disclosure. Each of the elements 310-368 shown in FIG. 3A correspond to like-numbered elements shown in FIG. 2, which have been described previously. For example, cylindrical tube 310 in FIG. 3A corresponds to cylindrical tube 210 in FIG. 2, and so on. Film roll core 300 includes a cylindrical tube 310 having an inner surface 312, an outer surface 314, and an axis of rotation 315. An engagement cover 360 comprising a resilient looped pile fabric 368 and a base layer 364 is disposed over the outer surface 314 of the cylindrical tube 310, such that the base layer 364 is adjacent the outer surface 314. In some cases, additional layers (not shown) such as compliant layers including rubber, closed- or open-celled foam, and the like, can be disposed between the base layer 364 and the outer surface 314 of the cylindrical tube 310.

In one particular embodiment, a web (for example, a film) 320 to be wound on the film roll core 300 can be affixed to the resilient looped pile fabric 368 of the engagement cover 360 using a pressure-sensitive tape (for example, a transfer tape) 323 that extends over a starting end 322 of the polymeric film 320. The polymeric film 320, which has a thickness "t", can then be wound with a tension "T" around film roll core 300. In some cases (not shown), the polymeric film 320 can instead be affixed to the resilient looped pile fabric 368 using double-sided tape that could be placed entirely between the polymeric film 320 and the resilient looped pile fabric 368, and not extend beyond the starting end 322. In some cases, the attachment of the adhesive tape 323 to the resilient looped pile fabric 368 can be strong enough to begin the winding process, and still be readily removable from the core after the material has been unwound, such that the film roll core 300 can be re-used without replacing the engagement cover 360.

Figure 3B:
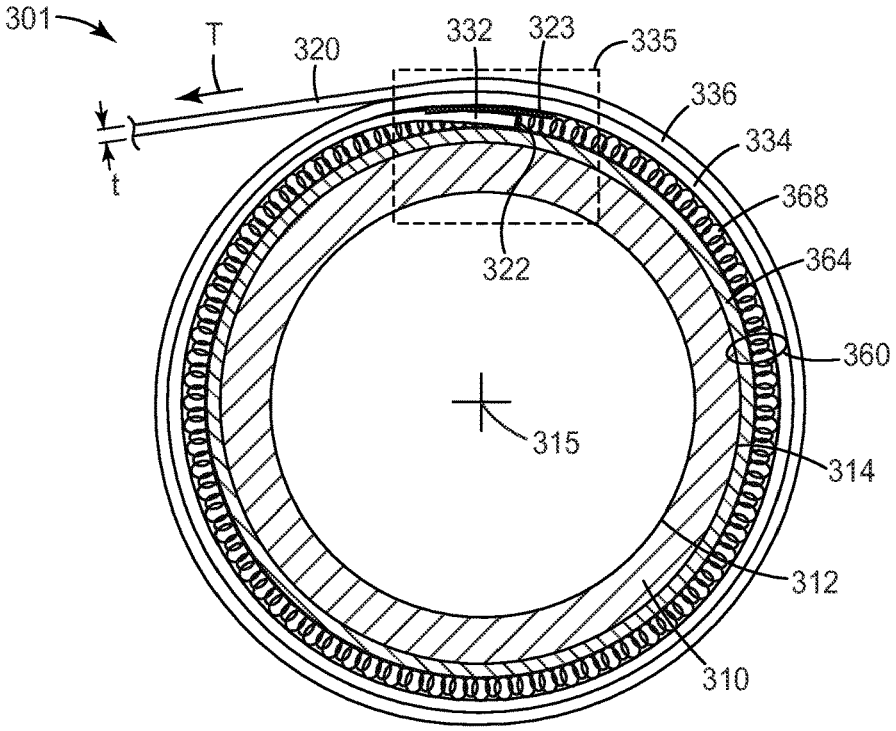
FIG. 3B shows a cross-sectional end view of a film roll core having film wraps.

FIG. 3B shows a cross-sectional end view of a film roll core 301 having film wraps, according to one aspect of the disclosure. Each of the elements 310-368 shown in FIG. 3B correspond to like-numbered elements shown in FIG. 3A, which have been described previously. For example, cylindrical tube 310 in FIG. 3B corresponds to cylindrical tube 310 in FIG. 3A, and so on. Film roll core 301 having film wraps includes a first layer wrap 332, a second layer wrap 334, and a third layer wrap 336.

A starting end 322 of a polymeric film 320 is disposed on the outer surface 314 of the cylindrical tube 310, and the polymeric film 320 is wound around the cylindrical tube 310. The starting end 322 of the polymeric film 320 can be attached to the core using an adhesive tape 323 on the resilient looped pile fabric 368. Alternatively, a double-sided tape can be used, as described elsewhere. An overlap region 335 is generated by the tension "T" applied to the polymeric film 320 as second layer wrap 334 of polymeric film 320 overlays the starting end 322 of the first layer wrap 332 and the adhesive tape 323. The overlap region 335 does not generate a region of increased stress (similar to region of increased stress 130 shown in FIG. 1B) which could result in a visible deformation in the polymeric film, since the overlap compresses the resilient looped pile fabric 368. The third layer wrap 336 and subsequent layer wraps generally follows the contour of the surface over which it is wrapped, and smooth wraps follow the outer surface 314 of the cylindrical tube.

Figure 4A:
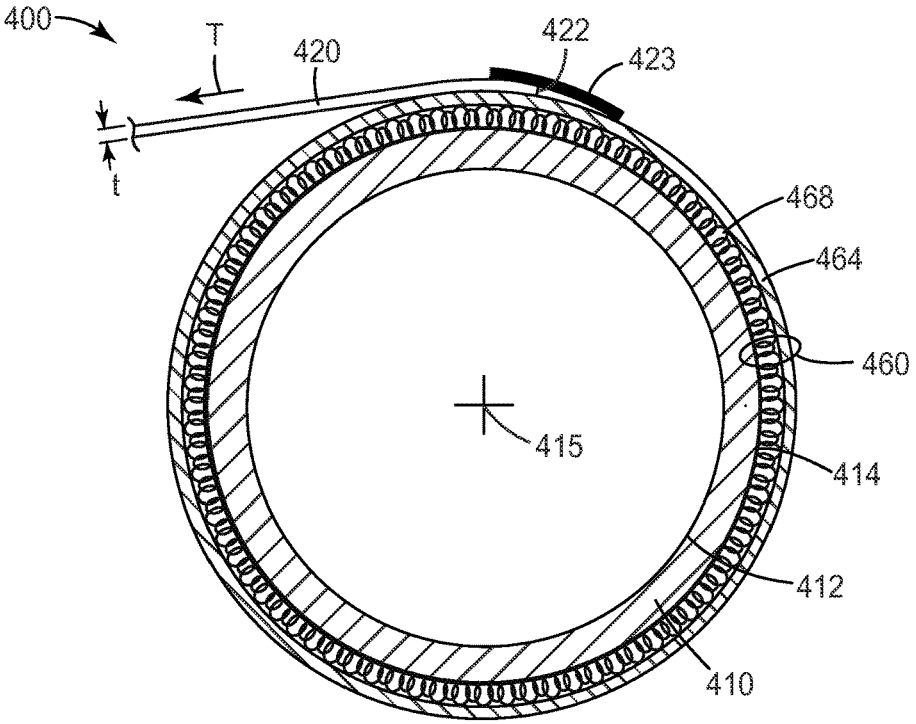
FIG. 4A shows a cross-sectional end view of a film roll core.
Figure 4B:
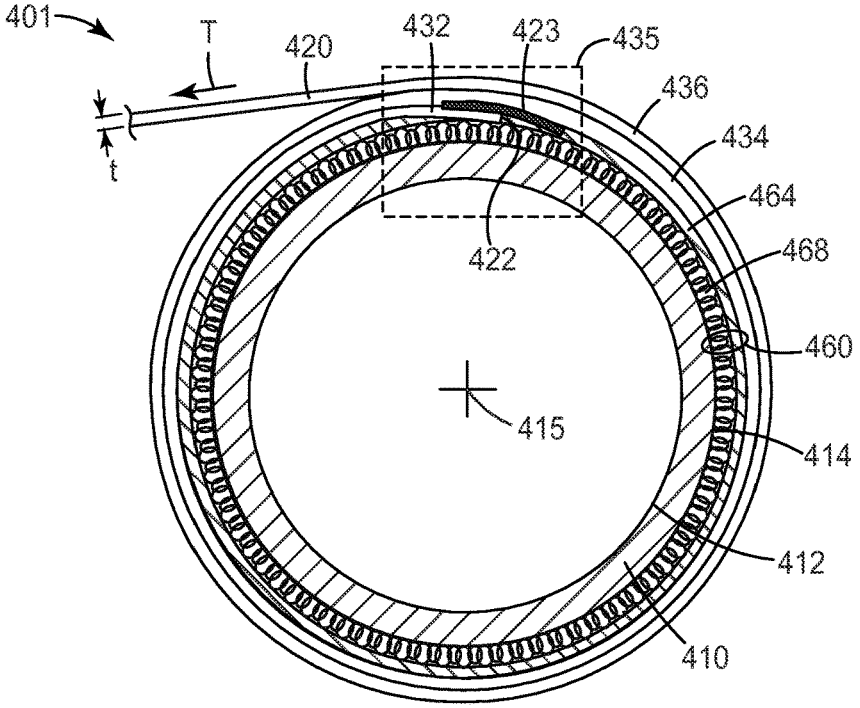
FIG. 4B shows a cross-sectional end view of a film roll core having film wraps.

FIG. 4A shows a cross-sectional end view of a film roll core 400, according to one aspect of the disclosure. In FIG. 4A and FIG. 4B, the engagement cover is reversed such that the looped pile surface is between the base layer and the outer surface of the cylindrical tube. Each of the elements 410-468 shown in FIG. 4A correspond to like-numbered elements shown in FIG. 3A, which have been described previously. For example, cylindrical tube 410 in FIG. 4A corresponds to cylindrical tube 310 in FIG. 3A, and so on. An engagement cover 460 comprising a resilient looped pile fabric 468 and a base layer 464 is disposed over the outer surface 414 of the cylindrical tube 410, such that the resilient looped pile fabric 468 is adjacent the outer surface 414. In some cases, additional layers (not shown) such as compliant layers including rubber, closed- or open-celled foam, and the like, can be disposed between the resilient looped pile fabric 468 and the outer surface 414 of the cylindrical tube 410.

In one particular embodiment, a web (for example, a film) 420 to be wound on the film roll core 400 can be affixed to the base layer 464 of the engagement cover 460 using a pressure-sensitive tape (for example, a transfer tape) 423 that extends over a starting end 422 of the polymeric film 420. The polymeric film 420, which has a thickness "t", can then be wound with a tension "T" around film roll core 400. In some cases (not shown), the polymeric film 420 can instead be affixed to the base layer 464 using double-sided tape that could be placed entirely between the polymeric film 420 and the base layer 464, and not extend beyond the starting end 422. In some cases, the attachment of the adhesive tape 423 to the base layer 464 can be strong enough to begin the winding process, and still be readily removable from the core after the material has been unwound, such that the film roll core 400 can be re-used without replacing the engagement cover 460.

FIG. 4B shows a cross-sectional end view of a film roll core 401 having film wraps, according to one aspect of the disclosure. Each of the elements 410-468 shown in FIG. 4B correspond to like-numbered elements shown in FIG. 4A, which have been described previously. For example, cylindrical tube 410 in FIG. 4B corresponds to cylindrical tube 410 in FIG. 4A, and so on. Film roll core 401 having film wraps includes a first layer wrap 432, a second layer wrap 434, and a third layer wrap 436.

A starting end 422 of a polymeric film 420 is disposed on the outer surface 414 of the cylindrical tube 410, and the polymeric film 420 is wound around the cylindrical tube 410. The starting end 422 of the polymeric film 420 can be attached to the core using an adhesive tape 423 on the base layer 464. Alternatively, a double-sided tape can be used, as described elsewhere. An overlap region 435 is generated by the tension "T" applied to the polymeric film 420 as second layer wrap 434 of polymeric film 420 overlays the starting end 422 of the first layer wrap 432 and the adhesive tape 423. The overlap region 435 does not generate a region of increased stress (similar to region of increased stress 130 shown in FIG. 1B) which could result in a visible deformation in the polymeric film, since the overlap compresses the resilient looped pile fabric 468 underlying the base layer 464. The third layer wrap 436 and subsequent layer wraps generally follows the contour of the surface over which it is wrapped, and smooth wraps follow the outer surface 414 of the cylindrical tube.

In some cases, a film roll core may comprise tubes with multiple engagement covers installed thereon, mounted concentrically, or alternately, with other compliant materials such as an open- or closed-cell compliant foam, between the tube surface and the engagement cover. This may be done to yield a thicker cushion depth, thus increasing the compressibility effect of the engagement cover(s). In some cases, a material that is less compliant, for example a rigid shell, can be mounted between the tube surface and the engagement cover, if desired.

The film roll cores can be used in connection with a wide variety of web materials. It is well suited and can provide particular advantage in connection with the manufacture and handling of webs of high quality polymeric materials such as optical films. Such films, typically comprising one or more layers of select polymeric materials, for example, radiation-cured compositions, typically require precise and uniform specifications of width, thickness, film properties, etc. with very low defect rates. The web material may be of monolayer or multilayer construction.

In some embodiments, the web is a simple film, for example, of polyester (for example, photograde polyethylene terephthalate and MELINEX™ PET from DuPont Films) or polycarbonate. In some embodiments, the film comprises such materials as, for example, styrene-acrylonitrile, cellulose acetate butyrate, cellulose acetate propionate, cellulose triacetate, polyether sulfone, polymethyl methacrylate, polyurethane, polyester, polycarbonate, polyvinyl chloride, polystyrene, polyethylene naphthalate, copolymers or blends based on naphthalene dicarboxylic acids, polycyclo-olefins, and polyimides.

The engagement covers described herein have a low radial modulus of elasticity with enhanced tribological characteristics. As a result, the disclosure provides a convenient, low cost way to reduce undesirable effects on the web during web winding.

The engagement covers provide a resilient low radial modulus of elasticity character to the roller surface which compensates for many pertubations encountered in a complex web transport system, for example, tension variations and speed variations, due to any of myriad causes, for example, variation in web properties such as thickness, modulus, etc., variations in performance or characteristics of individual rolls in a system comprising many rolls, power fluctuations in drive rolls, and the like. In accordance with the disclosure, the covers enable the web to avoid buckling and wrinkling when it otherwise might.

EXAMPLE

An engagement cover was made using a polyester/Lycra® blend base knit layer and a loop layer of polyester. A 70 denier white polyester yarn was used to knit the material over a cylinder that was 9.5 inches (24.1 cm) in diameter and had 800 needles. The terry loop sinker height needles were 1.5 mm. The finished relaxed engagement cover diameter was about 8 inches (20.3 cm). A cylindrical tube 12.65 inch (32.1 cm) diameter by 132 inch (335 cm) long steel core was used, and the engagement cover was stretched over the core and held in place by 3M Scotchmate™ Hook & Loop Fastener (Hook only) at the ends of the core. The engagement cover was stretched so that it was fairly snug but was not over stretched. The resulting looped pile film core had between 191 to 216 inches of engagement cover on the core, with the terry loop facing inward to the core and the jersey base knit facing outward to the film.

Four different variation of the engagement cover were used to determine which material was the most effective in reducing core impressions on a film processing line. The denier of the yarn was varied, using a 150, 100 and 70 denier yarns blended with the Lycra® material in the base knit, and one 70 denier yarn without Lycra® in the base knit. Approximately the same length of engagement cover was put on each of the cores to get about the same amount of stretch. All of the winding variables (tension, speed, etc) were the same for each of the samples. The film materials used were a Vikuiti™ Enhanced Specular Reflector (ESR) film, a Window Film and a Puncture/Tear resistant film all made by 3M Company and wound on the film line. Some of the experimental film used for the Example included material that was out of specification for external sale, however some was in-spec film. Either 1500 or 2500 yards of material were wound on the cores for the Example. A 3M double sided transfer tape (3M™ 9425 Double coated repositionable tape) was used and stuck well to the engagement cover material and film.

The 150 denier material showed no core impressions towards the center of the core but "spoking" winding defects were observed. There was also an engagement cover impression that was seen on the film. The 100 denier material showed core impressions at about 5 wraps in from the core center and had no visible signs of spoking. The 70 denier material with and without Lycra also showed no core impressions at a couple of wraps with no visible signs of spoking. Both the 100 and 70 denier material worked well with no core impressions; however, the 70 denier material with Lycra was preferable because there was less chance of spoking and the cover had a more snug fit on the core.

Following are a list of embodiments of the present disclosure.

Item 1 is a film roll core, comprising: a cylindrical tube having an outer surface; and an engagement cover comprising a resilient looped pile fabric, the engagement cover disposed over the outer surface of the cylindrical tube.

Item 2 is the film roll core of item 1, wherein the resilient looped pile fabric is a knit fabric comprising a base layer having first and second faces and a resilient looped pile protruding from the first face.

Item 3 is the film roll core of item 2, wherein the base layer comprises a woven base layer, a knitted base layer, a non-woven base layer, or a combination thereof.

Item 4 is the film roll core of item 1 to item 3, wherein the engagement cover attaches to the outer surface of the cylindrical tube by compression, adhesion, mechanical attachment, or a combination thereof.

Item 5 is the film roll core of item 1 to item 4, wherein the resilient looped pile faces toward the outer surface of the cylindrical tube.

Item 6 is the film roll core of item 1 to item 5, wherein the resilient looped pile faces away from the outer surface of the cylindrical tube.

Item 7 is the film roll core of item 1 to item 6, wherein the engagement cover comprises a tube shape or a rectangle shape.

Item 8 is the film roll core of item 1 to item 7, wherein the resilient looped pile fabric comprises a fibrous material selected from poly(tetrafluoroethylene), aramid, polyester, polypropylene, nylon, wool, bamboo, cotton, or a combination thereof.

Item 9 is the film roll core of item 1 to item 8, wherein the engagement cover further comprises a material that shrinks when exposed to heat, moisture, or a combination thereof.

Item 10 is the film roll core of item 9, wherein the material that shrinks comprises wool, cotton, polyvinylalcohol (PVA), polyester, or a combination thereof.

Item 11 is the film roll core of Item 9 or item 10, wherein the material that shrinks comprises a fiber.

Item 12 is the film roll core of item 1 to item 11, further comprising an adhesive disposed between at least a portion of the cylindrical tube and the engagement cover.

Item 13 is the film roll core of item 1 to item 12, further comprising a hooked fastener disposed adjacent to at least one end of the outer surface of the cylindrical tube, thereby attaching the engagement cover to the cylindrical tube.

Item 14 is the film roll core of item 1 to item 13, wherein the resilient looped pile fabric comprises a fiber having a size ranging from about 70 denier to about 200 denier.

Item 15 is the film roll core of item 1 to item 14, wherein the resilient looped pile fabric comprises loops having a height from about 1.25 mm to about 2.7 mm.

Item 16 is the film roll core of item 1 to item 15, wherein the cylindrical tube comprises a steel tube, and aluminum tube, a polymeric tube, a composite tube, or a paper tube.

Item 17 is a method of winding film, comprising: disposing a film tangentially adjacent to a film roll core, the film roll core comprising: a cylindrical tube having an outer surface; an engagement cover comprising a resilient looped pile fabric, the engagement cover disposed over the outer surface of the cylindrical tube; adhering the film to the engagement cover; maintaining tension on the film; and rotating the film roll core about a central axis, thereby winding the film onto the film roll core.

Item 18 is the method of item 17, wherein adhering the film comprises applying a single-sided adhesive tape to the film and to the engagement cover.

Item 19 is the method of item 17, wherein adhering the film comprises applying a double-sided adhesive tape between the film and the engagement cover.

Item 20 is a roll of film, comprising: a film roll core comprising: a cylindrical tube having an outer surface; an engagement cover comprising a resilient looped pile fabric, the engagement cover disposed over the outer surface of the cylindrical tube; and a web of film wound around the engagement cover, wherein a first film edge of the web of film compresses the engagement cover such that subsequently wound layers of the web of film include minimal impressions of the first film edge and/or a transfer tape secured to the first film edge.

Unless otherwise indicated, all numbers expressing feature sizes, amounts, and physical properties used in the specification and claims are to be understood as being modified by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein.

All references and publications cited herein are expressly incorporated herein by reference in their entirety into this disclosure, except to the extent they may directly contradict this disclosure. Although specific embodiments have been illustrated and described herein, it will be appreciated by those of ordinary skill in the art that a variety of alternate and/or equivalent implementations can be substituted for the specific embodiments shown and described without departing from the scope of the present disclosure. This application is intended to cover any adaptations or variations of the specific embodiments discussed herein. Therefore, it is intended that this disclosure be limited only by the claims and the equivalents thereof.

What is claimed is:

1. A film roll core, comprising:

a cylindrical tube having an outer surface; and an engagement cover comprising a resilient looped pile fabric, the engagement cover disposed over the outer surface of the cylindrical tube covering substantially the entirety of the cylindrical surface of the cylindrical tube wherein the resilient looped pile fabric is a knit fabric comprising a base layer having first and second faces and a resilient looped pile protruding from the first face, the resilient looped pile fabric comprising a fiber having a size ranging from about 50 denier to about 500 denier and loops having a loop height from about 0.4 mm to about 3.0 mm; a film tangentially adjacent to the engagement cover.

2. The film roll core of claim 1, wherein the base layer comprises a woven base layer, a knitted base layer, a non-woven base layer, or a combination thereof.

3. The film roll core of claim 1, wherein the engagement cover attaches to the outer surface of the cylindrical tube by compression, adhesion, mechanical attachment, or a combination thereof.

4. The film roll core of claim 1, wherein the resilient looped pile faces toward the outer surface of the cylindrical tube.

5. The film roll core of claim 1, wherein the resilient looped pile faces away from the outer surface of the cylindrical tube.

6. The film roll core of claim 1, wherein the engagement cover comprises a tube shape or a rectangle shape.

7. The film roll core of claim 1, wherein the resilient looped pile fabric comprises a fibrous material selected from poly(tetrafluoroethylene), aramid, polyester, polypropylene, nylon, wool, bamboo, cotton, or a combination thereof.

8. The film roll core of claim 1, wherein the engagement cover further comprises a material that shrinks when exposed to heat, moisture, or a combination thereof.

9. The film roll core of claim 8, wherein the material that shrinks comprises wool, cotton, polyvinylalcohol (PVA), polyester, or a combination thereof.

10. The film roll core of claim 8, wherein the material that shrinks comprises a fiber.

11. The film roll core of claim 1, further comprising an adhesive disposed between at least a portion of the cylindrical tube and the engagement cover.

12. The film roll core of claim 1, further comprising a hooked fastener disposed adjacent to at least one end of the outer surface of the cylindrical tube, thereby attaching the engagement cover to the cylindrical tube.

13. The film roll core of claim 1, wherein the resilient looped pile fabric comprises a fiber having a size ranging from about 70 denier to about 200 denier.

14. The film roll core of claim 1, wherein the resilient looped pile fabric comprises loops having a height from about 1.25 mm to about 2.7 mm.

15. The film roll core of claim 1, wherein the cylindrical tube comprises a steel tube, and aluminum tube, a polymeric tube, a composite tube, or a paper tube.

16. A method of winding film, comprising:

disposing a film tangentially adjacent to a film roll core, the film roll core comprising:

a cylindrical tube having an outer surface;

an engagement cover comprising a resilient looped pile fabric, the engagement cover disposed over the outer surface of the cylindrical tube covering substantially the entirety of the cylindrical surface of the cylindrical tube wherein the resilient looped pile fabric is a knit fabric comprising a base layer having first and second faces and a resilient looped pile protruding from the first face, the resilient looped pile fabric comprising a fiber having a size ranging from about 70 denier to about 200 denier and loops having a loop height from about 0.4 mm to about 3.0 mm;

adhering the film to the engagement cover;

maintaining tension on the film; and rotating the film roll core about a central axis, thereby winding the film onto the film roll core.

17. The method of claim 16, wherein adhering the film comprises applying a single-sided adhesive tape to the film and to the engagement cover.

18. The method of claim 16, wherein adhering the film comprises applying a double-sided adhesive tape between the film and the engagement cover.

19. A roll of film, comprising:

a film roll core comprising:

a cylindrical tube having an outer surface;

an engagement cover comprising a resilient looped pile fabric, the engagement cover disposed over the outer surface of the cylindrical tube covering substantially the entirety of the cylindrical surface of the cylindrical tube wherein the resilient looped pile fabric is a knit fabric comprising a base layer having first and second faces and a resilient looped pile protruding from the first face, the resilient looped pile fabric comprising a fiber having a size ranging from about 70 denier to about 200 denier and loops having a loop height from about 0.4 mm to about 3.0 mm; and a web of film wound around the engagement cover, wherein a first film edge of the web of film compresses the engagement cover such that subsequently wound layers of the web of film include minimal impressions of the first film edge and/or a transfer tape secured to the first film edge.

* * * * *